US008988974B2

(12) United States Patent
Takenawa

(10) Patent No.: US 8,988,974 B2
(45) Date of Patent: Mar. 24, 2015

(54) DISPLAY APPARATUS AND ELECTRONIC TIMEPIECE

(71) Applicant: Casio Computer Co., Ltd., Tokyo (JP)

(72) Inventor: Hideo Takenawa, Hachioji (JP)

(73) Assignee: Casio Computer Co., Ltd., Tokyo (JP)

( * ) Notice: Subject to any disclaimer, the term of this patent is extended or adjusted under 35 U.S.C. 154(b) by 100 days.

(21) Appl. No.: 13/789,563

(22) Filed: Mar. 7, 2013

(65) Prior Publication Data

US 2013/0235706 A1 Sep. 12, 2013

(30) Foreign Application Priority Data

Mar. 12, 2012 (JP) ..... 2012-054309

(51) Int. Cl.
*G04B 19/04* (2006.01)
*G04C 3/14* (2006.01)

(52) U.S. Cl.
CPC ..... *G04B 19/04* (2013.01); *G04C 3/143* (2013.01)
USPC ..... 368/80; 368/228; 368/11; 116/220; 116/303; 73/384

(58) Field of Classification Search
USPC ..... 368/80, 228, 238, 11; 116/220, 303; 73/384
See application file for complete search history.

(56) References Cited

U.S. PATENT DOCUMENTS

| | | | | |
|---|---|---|---|---|
| 4,287,457 | A * | 9/1981 | Takemura | 318/133 |
| 6,327,226 | B1 * | 12/2001 | Russi | 368/228 |
| 6,580,666 | B2 * | 6/2003 | Yamaya | 368/80 |
| 2004/0233788 | A1 * | 11/2004 | Plancon et al. | 368/11 |
| 2004/0233791 | A1 * | 11/2004 | Plancon et al. | 368/80 |
| 2008/0084792 | A1 * | 4/2008 | Hayashi et al. | 368/80 |
| 2008/0225648 | A1 * | 9/2008 | Kawaguchi | 368/66 |
| 2010/0002545 | A1 * | 1/2010 | Kitahara et al. | 368/37 |
| 2012/0188855 | A1 * | 7/2012 | Hayashi et al. | 368/66 |
| 2012/0287759 | A1 * | 11/2012 | Manaka | 368/80 |

FOREIGN PATENT DOCUMENTS

| | | | |
|---|---|---|---|
| JP | 351182 | U | 11/1944 |
| JP | 11-160360 | A | 6/1999 |
| JP | 2008-116435 | A | 5/2008 |

OTHER PUBLICATIONS

Japanese Office Action dated Dec. 20, 2013 (and English translation thereof) in counterpart Japanese Application No. 2012-054309.

* cited by examiner

*Primary Examiner* — Amy Cohen Johnson
*Assistant Examiner* — Matthew Powell
(74) *Attorney, Agent, or Firm* — Holtz, Holtz, Goodman & Chick PC

(57) ABSTRACT

A display apparatus characterized by having a scale mark display section which is provided in a predetermined display area; a pointer which moves on the scale mark display section and indicates a scale mark in the scale mark display section; a stepping motor which drives the pointer; a stopper section which is positioned in an end section of the scale mark display section and which restricts movement range of the pointer; and a movable supporting section which movably supports the stopper section.

4 Claims, 10 Drawing Sheets

DISPLAY APPARATUS AND ELECTRONIC TIMEPIECE

CROSS-REFERENCE TO RELATED APPLICATION

This application is based upon and claims the benefit of priority from the prior Japanese Patent Application No. 2012-054309, filed Mar. 12, 2012, the entire contents of which is incorporated herein by reference.

BACKGROUND OF THE INVENTION

1. Field of the Invention

The present invention relates to a display apparatus used in devices, such as timepieces and meters, and an electronic timepiece equipped with the display apparatus.

2. Description of the Related Art

For example, as described in Japanese Patent Application Laid-Open (Kokai) Publication No. Heisei 11-160360, a display apparatus is known, which is used in a meter that indicates and displays speed. This type of display apparatus is configured to drive by a stepping motor a pointer (or a hand) that moves on the dial where scale marks for speed are displayed, thereby indicating a scale mark for speed on the dial.

The dial in this type of display apparatus is provided with scale marks such that the scale marks for speed are provided within a predetermined range on the top surface of the dial, and a stopper section in order that the position of the pointer is restricted to a starting point position of the scale marks for speed. As a result, in the display apparatus, the pointer is rotated by the stepping motor, whereby a scale mark for speed is indicated. Then, the pointer is rotated in the reverse direction by the stepping motor, whereby the pointer is returned to the starting point position, and then the stepping motor stops.

The stepping motor includes a coil section, a stator, and a rotor. In the stepping motor, by current being sent to the coil section, an alternating magnetic field is generated in the stator. Then, by the alternating magnetic field, the rotor including a magnet is rotated in steps of 180 degrees. In this structure, the stator is provided with a through hole where the rotor is arranged. Notches are provided on the inner surface of the through hole such that the notches are opposite to each another. The notches restrict the rotational position of the rotor each time the rotor rotates by 180 degrees.

In this type of display apparatus, when the pointer is strongly pressed against the stopper section by external impact being received in a state where the stepping motor is stopped by the pointer being positioned in the starting point position and being in contact with the stopper section, the stop position of the rotor in the stepping motor may become misaligned in relation to the notches provided in the through hole of the stator. As a result, the rotor cannot be rotated by the alternating magnetic field even when the current is sent to the coil section and the alternating magnetic field is generated in the stator.

SUMMARY OF THE INVENTION

An object of the present invention is to provide a display apparatus and an electronic timepiece such that a stepping motor can be unfailingly operated even when external impact is received.

In order to achieve the above-described object, in accordance with one aspect of the invention, there is provided a display apparatus comprising: a scale mark display section which is provided in a predetermined display area; a pointer which moves on the scale mark display section and indicates a scale mark in the scale mark display section; a stepping motor which drives the pointer; a stopper section which is positioned in an end section of the scale mark display section and which restricts movement range of the pointer; and a movable supporting section which movably supports the stopper section.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

BRIEF DESCRIPTION OF THE DRAWINGS

FIG. 4A and FIG. 4B are diagrams of a correspondence relationship between a stator and a rotor in a stepping motor of the display apparatus shown in FIG. 3, in which FIG. 4A is an enlarged front view of main sections in a state where the rotor is stopped in a properly aligned position, and FIG. 4B is an enlarged front view of main sections in a state where the rotor is stopped in a position misaligned from the properly aligned position;

FIG. 5A and FIG. 5B are diagrams of a correspondence relationship between a pointer and first and second stopper pins in the display apparatus shown in FIG. 3, in which FIG. 5A is an enlarged front view of main sections in a state where the pointer is in contact with either of the first and second stopper pins, and FIG. 5B is an enlarged front view of main sections in a state where the pointer presses either of the first and second stopper pins in the state shown in FIG. 5A, whereby a rotating interlocking plate is rotated;

FIG. 8A and FIG. 8B are diagrams of respective correspondence relationships among a pointer, first and second stopper sections, and the pair of eccentric rotating bodies in the display apparatus shown in FIG. 6, in which FIG. 8A is an enlarged front view of main sections in a state where the pointer is in contact with either of the first and second stopper sections, and FIG. 8B is an enlarged front view of main sections in a state where the pointer presses the first stopper section in the state in FIG. 8A, whereby the eccentric rotating bodies are eccentrically rotated:

FIG. 10A and FIG. 10B are diagrams of respective correspondence relationships among a pointer, first and section stopper pins, and a pair of flat springs in the display apparatus shown in FIG. 9, in which FIG. 10A is an enlarged front view of main sections in a state where the pointer is in contact with either of the first and second stopper pins, and FIG. 10B is an enlarged front view of main sections in a state where the pair of flat springs become flexed and deformed when the pointer presses the first and second stopper pins in the state shown in FIG. 10A.

DETAILED DESCRIPTION OF THE PREFERRED EMBODIMENTS

First Embodiment

A first embodiment in which the present invention has been applied to a dial-type wristwatch will hereinafter be described with reference to FIG. 1 to FIG. 5A and FIG. 5B.

Figure 1:
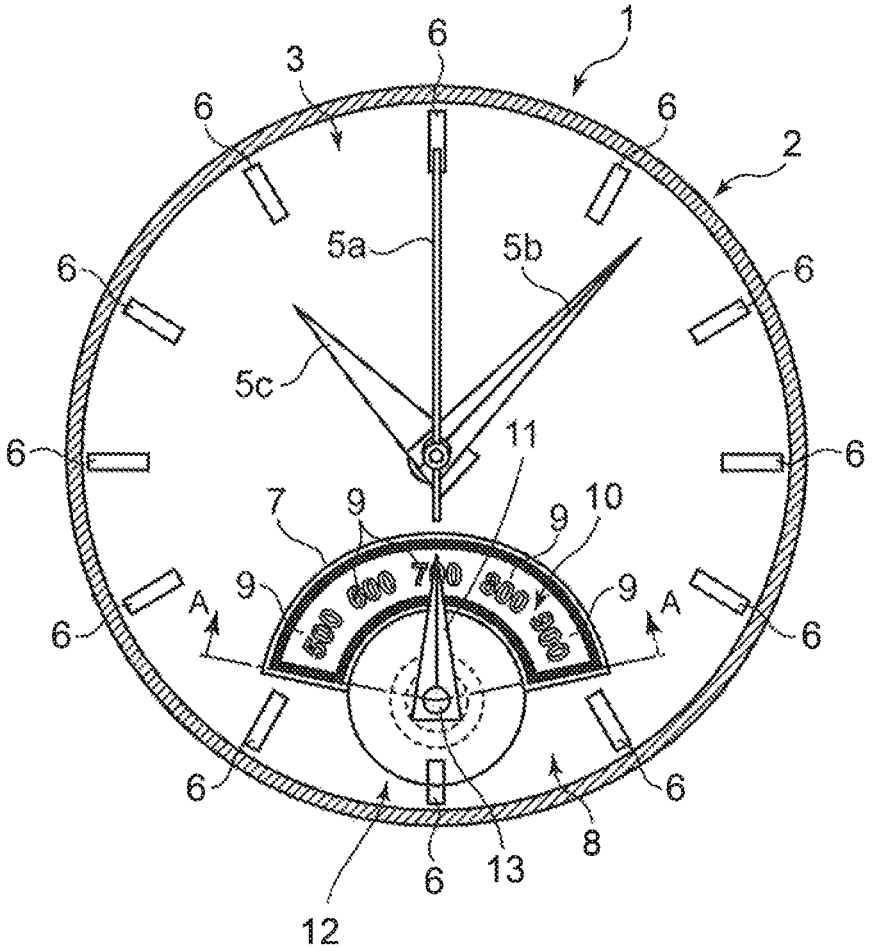
FIG. 1 is an enlarged front view of a timepiece module according to a first embodiment in which the present invention is applied to a wristwatch.
Figure 2:
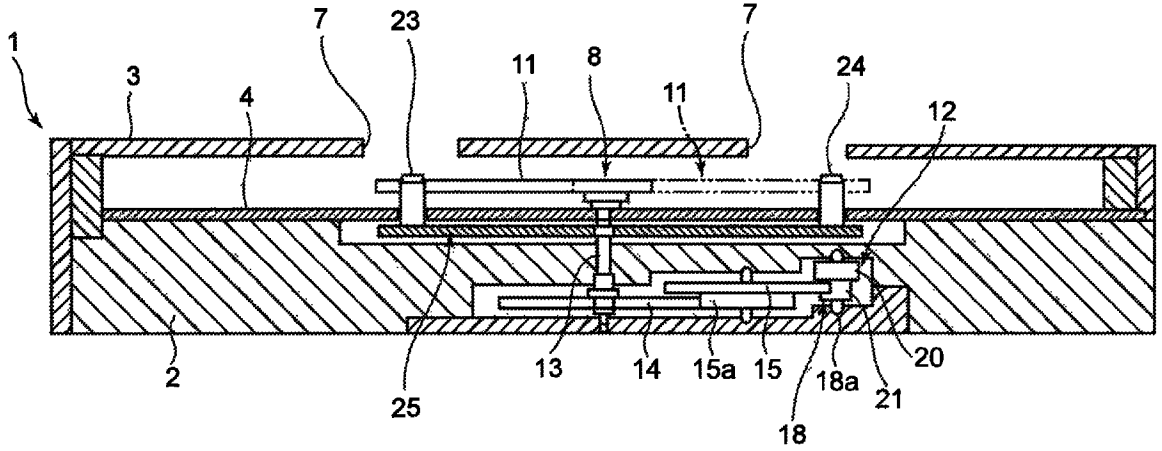
FIG. 2 is an enlarged cross-sectional view of the timepiece module shown in FIG. 1, taken along line A-A.

The wristwatch includes a timepiece module 1, as shown in FIG. 1 and FIG. 2. The timepiece module 1 is arranged within a wristwatch case (not shown) and includes a housing 2.

An upper dial 3 and a lower dial 4 are arranged above the housing 2 in a state the upper dial 3 and the lower dial 4 are separated by a predetermined distance in the up/down direction, as shown in FIG. 2. As shown in FIG. 1, a second hand 5*a*, a minute hand 5*b*, and an hour hand 5*c* move on the upper dial 3 and time indicator marks 6 provided on the peripheral edge of the upper dial 3, whereby the time is indicated and displayed. An opening section 7 for retrograde display, such as a barometric pressure display, is provided in the upper dial 3 on the 6 o'clock side. The opening section 7 is formed into an arc-shaped long hole.

In addition, a display apparatus 8 for retrograde display, such as the barometric pressure display, is provided in the lower dial 4 and the housing 2 such that the display apparatus 8 corresponds to the opening section 7 of the upper dial 3, as shown in FIG. 1 and FIG. 2. The display apparatus 8 includes: a scale mark display section 10 that is provided on the lower dial 4; a pointer 11 that moves on the scale mark display section 10; and a stepping motor 12 that drives the pointer 11.

Figure 3:
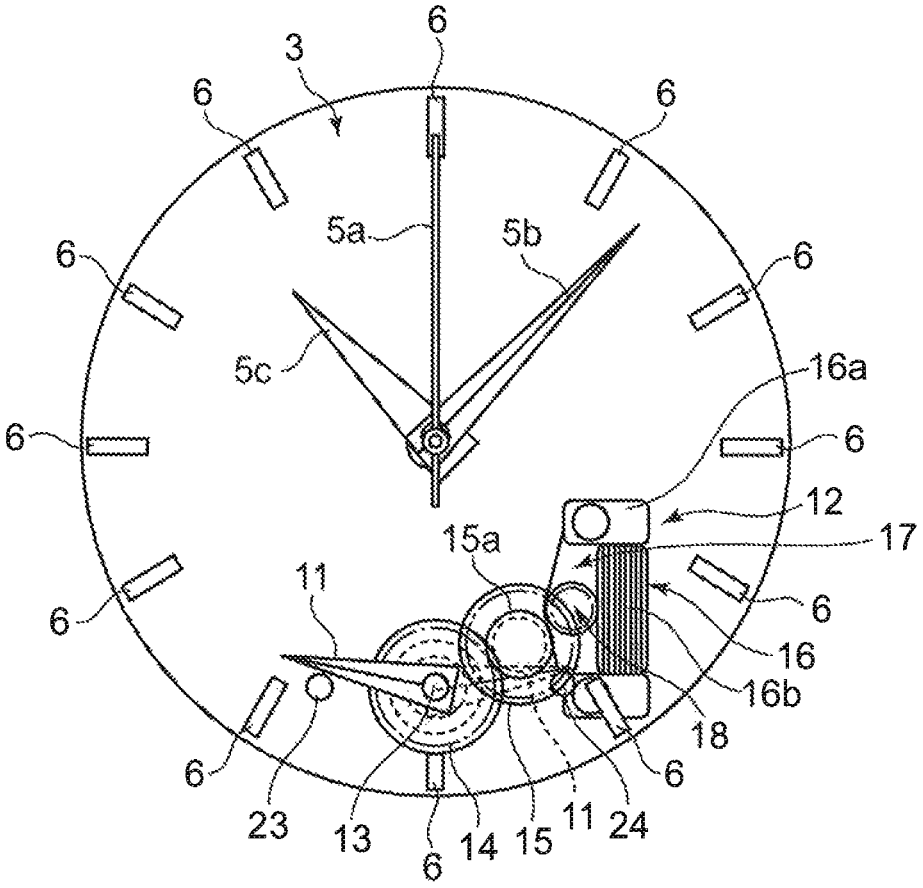
FIG. 3 is an enlarged front view of the timepiece module shown in FIG. 1, showing such that the timepiece module is seen through a display apparatus.

In the scale mark display section 10, scale marks 9 for retrograde display, such as barometric pressure, are provided on the lower dial 4 such that the scale marks 9 correspond to the opening section 7 of the upper dial 3, as shown in FIG. 1 to FIG. 3. The pointer 11 moves on the scale mark display section 10 by the rotation of the stepping motor 12, thereby indicating a scale mark 9 in the scale mark display section 10.

In other words, the pointer 11 is attached to an upper end portion of a pointer shaft 13, as shown in FIG. 1 to FIG. 3. A transmitting wheel 14 is provided in a lower portion of the pointer shaft 13. The transmitting wheel 14 is rotated via an intermediate wheel 15 by the stepping motor 12. As a result, the pointer shaft 13 is rotated by the stepping motor 12, whereby the pointer 11 rotates and moves on the lower dial 4.

In this structure, the pointer shaft 13 is attached to the housing 2 such that the intermediate portion of the pointer shaft 13 freely rotates as shown in FIG. 2 in a state where the pointer shaft 13 is positioned in the center of an arc corresponding to the arc-shaped opening section 7 as shown in FIG. 1. An upper end portion of the pointer shaft 13 projects above the lower dial 4 and the pointer 11 is attached to the projected portion. In addition, the transmitting wheel 14 attached to the lower portion of the pointer shaft 13 is meshed and rotated with a pinion 15*a* of the intermediate wheel 15 rotatably attached to the housing 2.

The stepping motor 12 includes a coil section 16, a stator 17, and a rotor 18, and is provided within the housing 2, as shown in FIG. 2 and FIG. 3. The coil section 16 is configured such that an alternating magnetic field is generated when an alternating current is supplied to the coil section 16 where the coil 16*b* wound around a core 16*a*. Both end portions of the stator 17 are respectively attached to both ends of the core 16*a* in a state where the stator 17 is arranged in parallel with the coil 16*b*, whereby the magnetic field generated in the coil section 16 is transmitted to the stator 17.

A shaft section 18*a* of the rotor 18 is rotatably attached to the housing 2 in a state where the rotor 18 is arranged within a through hole 17*a* provided in the intermediate portion of the stator 17, as shown in FIG. 2 and FIG. 3. The rotor 18 has a magnet section 20 that is arranged within the through hole 17*a* of the stator 17 and a rotor pinion 21 with which the intermediate wheel 15 meshes. When the magnet section 20 is arranged within the through hole 17*a* of the stator 17, Poles (N pole and S pole) of the magnet section 20 are divided at a line connecting a pair of notches 17*b* provided on the inner surface of the through hole 17*a* such that the pair of notches 17*b* are opposite to each other, as shown in FIG. 4A.

Figure 4A:
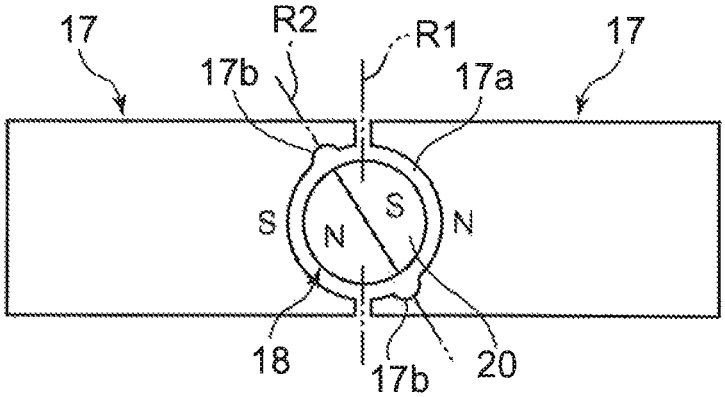

In this structure, as shown in FIG. 4A, the pair of notches 17*b* are provided such that the positions of pair of notches 17*b* are slightly shifted from the position where the through hole 17*a* of the stator 17 is divided into half in the longitudinal direction of the stator 17. In other words, the pair of notches 17*b* are provided on a line R2 that is slightly tilted in relation to a line R1 that divides the through hole 17*a* into half in the longitudinal direction of the stator 17. Accordingly, the magnet section 20 of the rotor 18 is arranged within the through hole 17*a* of the stator 17 in a state where the boundary portion of the poles (N pole and S pole) corresponds to the pair of notches 17*b* in the through hole 17*a* of the stator 17.

As a result, the rotor 18 is configured as follows: when the alternating current flows to the coil section 16, the alternating magnetic field is generated in the stator 17. Then, the poles (N pole and S pole) of the alternating magnetic field alternately changes at a line connecting the pair of notches 17*b* in the through hole 17*a* of the stator 17, whereby the magnet section 20 rotates in steps of 180 degrees, as shown in FIG. 4A.

In addition, the rotor 18 is configured as follows: the stepped rotation of the rotor 18 is transmitted to the transmitting wheel 14 via the pinion 15*a* of the intermediate wheel 15 because the intermediate wheel 15 has meshed with the rotor pinion 21. As a result, the pointer shaft 13 is rotated by the rotation of the transmitting wheel 14, whereby the pointer 11 is moved, as shown in FIG. 2 and FIG. 3.

Figure 5A:
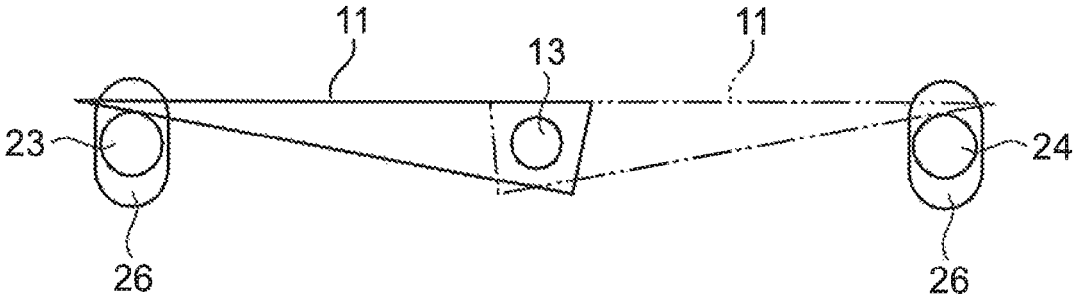
Figure 5B:
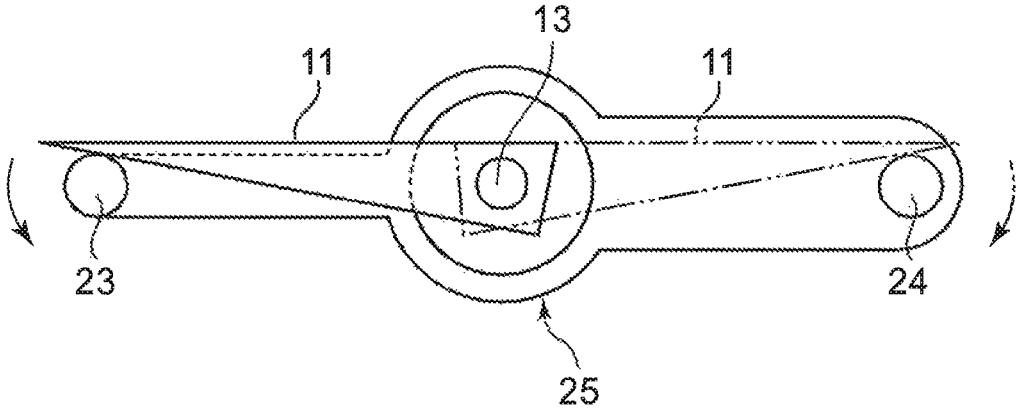
Figure 6:
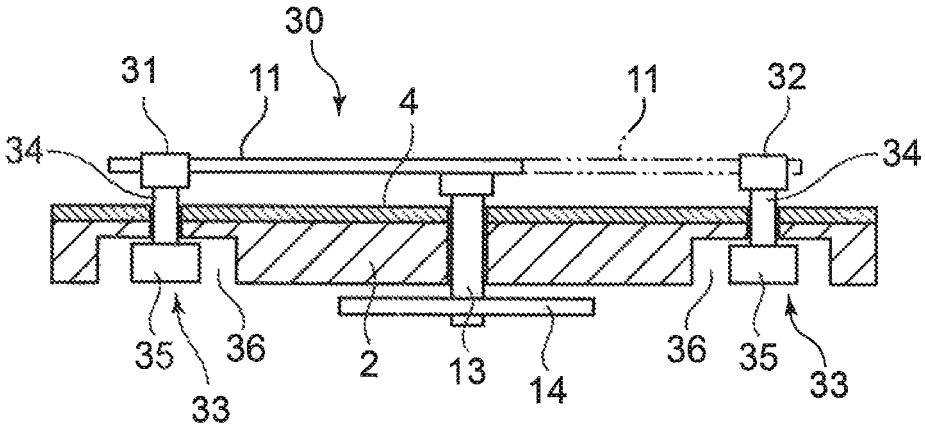
FIG. 6 is an enlarged cross-sectional view of main sections of a display apparatus of a timepiece module according to a second embodiment in which the present invention is applied to a wristwatch.

The display apparatus 8 further includes a first stopper pin 23 and a second stopper pin 24 (stopper section) that restrict the movement range of the pointer 11, and a rotating interlocking plate 25 (movable supporting section) that movably supports the first stopper pin 23 and the second stopper pin 24, as shown in FIG. 2, FIG. 5A, and FIG. 5B. The first stopper pin 23 and the second stopper pin 24 are respectively provided in both end portions of the rotating interlocking plate 25 in a state where the first stopper pin 23 and the second stopper pin 24 stand up.

In this structure, respective upper portions of the first stopper pin 23 and the second stopper pin 24 project above the lower dial 4 through a pair of insertion holes 26 that are respectively provided in portions of the lower dial 4 positioned on both end portions of the scale mark display section 10, as shown in FIG. 2, FIG. 5A, and FIG. 5B. Each of the pair of insertion holes 26 is formed into an arc-shaped long hole such that the center of the arc-shaped long hole coincides with the center of the pointer shaft 13 that is the rotational center of the rotating interlocking plate 25. The first stopper pin 23 and the second stopper pin 24 respectively move along these long holes.

An intermediate portion of the rotating interlocking plate 25 is rotatably attached to the pointer shaft 13, as shown in FIG. 2 and FIG. 5B. The rotating interlocking plate 25 is formed in a substantially band shape, and weight balance differs between the left side and right side of the rotational center of rotating interlocking plate 25. For example, the rotating interlocking plate 25 is formed such that the left side is thin and the right side is thick, as shown in FIG. 5B. Furthermore, in addition to the weight imbalance on either side of the rotational center, the rotating interlocking plate 25 is configured to return to its original predetermined position every time when rotated.

As a result, when the pointer 11 rotates in the counter-clockwise direction and presses the first stopper pin 23 in a state where the pointer 11 is in contact with the first stopper pin 23 on the left side as shown in FIG. 5A and FIG. 5B, the rotating interlocking plate 25 is rotated in the counter-clockwise direction by the first stopper pin 23 being pressed, whereby the second stopper needle 24 is moved in the same direction. In addition, the rotating interlocking plate 25 is rotated in the reverse direction by the rebound of the second stopper needle 24, whereby the first stopper pin 23 is pressed back.

In addition, when the pointer 11 rotates in the clockwise direction and presses the second stopper needle 24, in a state where the pointer 11 is in contact with the second stopper pin 24 on the right side as shown in FIG. 5A and FIG. 5B, the rotating interlocking plate 25 is rotated in the clockwise direction by the second stopper pin 24 being pressed, whereby the first stopper pin 23 is moved in the same direction. In addition, the rotating interlocking plate 25 is rotated in the reverse direction by the rebound of the rotation, whereby the second stopper pin 24 is pressed back.

Furthermore, when the rotor 18 of the stepping motor 12 will not rotate in a state where the pointer 11 is in contact with either of the first stopper pin 23 and the second stopper pin 24, the wristwatch is strongly shaken, whereby the rotating interlocking plate 25 is rotated in either direction because of the weight imbalance of the rotating interlocking plate 25. Accordingly, the first stopper pin 23 and the second stopper pin 24 are moved. As a result, the pointer 11 is moved, and the rotor 18 of the stepping motor 12 is forcibly rotated.

Next, the mechanism of the display apparatus 8 of the wristwatch will be described.

In the display apparatus 8, when barometric pressure is detected by a barometric sensor (not shown) mounted in the timepiece module 1, the stepping motor 12 is rotated based on the detected data. Specifically, an alternating current is supplied to the coil section 16 of the stepping motor 12 based on the detected data from the barometric pressure sensor, whereby an alternating magnetic field is generated in the stator 17. As a result, the rotor 18 is rotated in steps.

Then, the intermediate wheel 15 that has meshed with the rotor pinion 21 is rotated by the rotation of the rotor 18. The rotation of the intermediate wheel 15 is transmitted to the transmitting wheel 14 that has meshed with the pinion 15*a* of the intermediate wheel 15, and the pointer shaft 13 is rotated by the rotation of the transmitting wheel 14. The pointer 11 is then rotated by the rotation of the pointer shaft 13, thereby moving on the scale mark display section 10. As a result, the pointer 11 indicates a scale mark 9 in the scale mark display section 10 such that the pointer 11 indicates 700 (barometric pressure) as a scale mark 9 as shown in FIG. 1, whereby the barometric pressure is indicated and displayed.

When the pointer 11 stops in this state, energization of the stepping motor 12 is cut off, whereby the rotation of the rotor 18 stops. At this time, the rotor 18 stops in a state where the boundary portion of the poles (N pole and S pole) of the magnet section 20 of the rotor 18 corresponds to the pair of notches 17*b* in the through hole 17*a* of the stator 17. Therefore, the stepping motor 12 maintains a state where the rotor 18 can rotate the next time the barometric pressure is measured and a current is supplied to the coil section 16.

In addition, when the wristwatch receives external impact in this state, the pointer 11 may rotate in an oscillating manner by the external impact, and then the rotor 18 of the stepping motor 12 may also rotate. Even so, the boundary portion of the poles (N pole and S pole) of the magnet section 20 of the rotor 18 returns to its original state corresponding to the pair of notches 17*b* in the through hole 17*a* of the stator 17, whereby the pointer 11 is returned to the position according to the detected data from the barometric pressure sensor.

On the one hand, when the barometric pressure decreases, the rotor 18 of the stepping motor 12 rotates in the reverse direction, and the pointer 11 moves towards the first stopper pin 23 on the left side. Specifically, an alternating current is supplied to the coil section 16 of the stepping motor 12 such that the rotor 18 rotates in the reverse direction. As a result, the alternating magnetic field is generated in the stator 17, and the rotor 18 is rotated in the reverse direction. Accordingly, the pointer shaft 13 rotates in the reverse direction, and the pointer 11 moves on the scale mark display section 10 in the reverse direction. At this time, when the barometric pressure is at the lowest, the pointer 11 stops by coming into contact with the first stopper pin 23 on the left side.

Then, energization of the stepping motor 12 is cut off and the rotation of the rotor 18 stops. At this time, the rotor 18 stops in a state where the boundary portion of the poles (N pole and S pole) of the magnet section 20 of the rotor 18 corresponds to the pair of notches 17*b* in the through hole 17*a* of the stator 17. Therefore, the stepping motor 12 maintains a state where the rotor 18 can rotate the next time the barometric pressure is measured and a current is supplied to the coil section 16.

When the wristwatch receives external impact in this state and then the pointer 11 presses the first stopper pin 23 by the impact, the rotating interlocking plate 25 is rotated in the counter-clockwise direction by the first stopper pin 23 being pressed, whereby the second stopper pin 24 is moved in the same direction, as shown in FIG. 5B. Then, the rotating interlocking plate 25 is rotated in the reverse direction (in other words, rotated in the clockwise direction) by the rebound of the second stopper needle 24, whereby the first stopper pin 23 is pressed back.

Figure 4B:
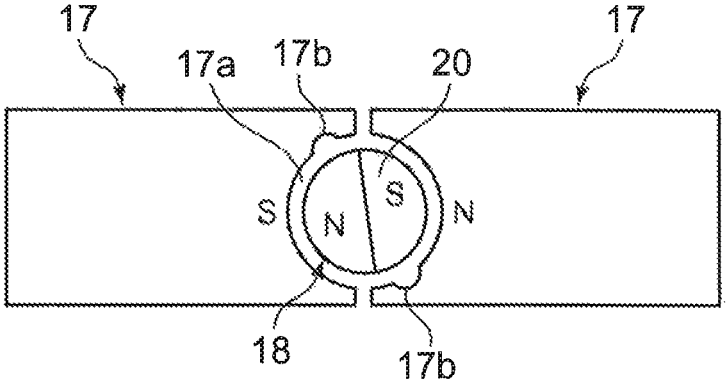

As described above, when the pointer 11 presses the first stopper pin 23, the rotor 18 of the stepping motor 12 may rotate slightly and then the boundary portion of the poles (N pole and S pole) of the magnet section 20 of the rotor 18 may become positionally misaligned in relation to the pair of notches 17*b* in the through hole 17*a* of the stator 17 as shown, in FIG. 4B, for example. Even so, the first stopper pin 23 is pressed back by the reverse rotation of the rotating interlocking plate 25.

As a result, in the stepping motor 12, the rotor 18 stops in a state where the boundary portion of the poles (N pole and S pole) of the magnet section 20 of the rotor 18 corresponds to the pair of notches 17*b* in the through hole 17*a* of the stator 17, as shown in FIG. 4A. Therefore, the stepping motor 12 is in a state where the rotor 18 can rotate the next time the barometric pressure is measured and a current is supplied to the coil section 16.

On the other hand, when the barometric pressure increases and then the pointer 11 stops by coming into contact with the second stopper pin 24 on the right side, energization of the stepping motor 12 is cut off and the rotation of the rotor 18 stops. At this time as well, the rotor 18 stops in a state where the boundary portion of the poles (N pole and S pole) of the magnet section 20 of the rotor 18 corresponds to the pair of notches 17*b* in the through hole 17*a* of the stator 17. Therefore, the stepping motor 12 is in a state where the rotor 18 can rotate the next time the barometric pressure is measured and a current is supplied to the coil section 16.

When the wristwatch receives external impact in this state and then the pointer 11 presses the second stopper pin 24 by the impact, the rotating interlocking plate 25 is rotated in the clockwise direction by the second stopper pin 24 being pressed, whereby the first stopper pin 23 is moved in the same direction, as shown by the two-dot chain line in FIG. 5B. Then, the rotating interlocking plate 25 is rotated in the reverse direction by the rebound of the first stopper pin 23, whereby the second stopper pin 24 is pressed back.

At this time as well, when the pointer 11 presses the second stopper pin 24, the rotor 18 of the stepping motor 12 may rotate slightly and then the boundary portion of the poles (N pole and S pole) of the magnet section 20 of the rotor 18 may become positionally misaligned in relation to the pair of notches 17*b* in the through hole 17*a* of the stator 17. Even so, the second stopper pin 24 is pressed back by the reverse rotation of the rotating interlocking plate 25.

As a result, in the stepping motor 12, the rotor 18 stops in a state where the boundary portion of the poles (N pole and S pole) of the magnet section 20 of the rotor 18 corresponds to the pair of notches 17*b* in the through hole 17*a* of the stator 17. Therefore, the stepping motor 12 is in a state where the rotor 18 can rotate the next time the barometric pressure is measured and a current is supplied to the coil section 16.

Furthermore, when for some reason the rotor 18 of the stepping motor 12 will not rotate in a state where the pointer 11 comes into contact with either of the first stopper pin 23 or the second stopper pin 24, the wristwatch is strongly shaken, whereby the rotating interlocking plate 25 is forcibly rotated in either direction. As a result, the pointer 11 is moved and the rotor 18 of the stepping motor 12 is forcibly rotated.

In other words, when the wristwatch is strongly shaken, the rotating interlocking plate 25 is rotated in either direction because of the weight imbalance of the rotating interlocking plate 25. Accordingly, the first stopper pin 23 and the second stopper pin 24 are moved, and the pointer 11 is rotated, whereby the rotor 18 of the stepping motor 12 is rotated.

As a result, even when the pointer 11 stops in a state where the boundary portion of the poles (N pole and S pole) of the magnet section 20 of the rotor 18 is positionally misaligned in relation to the pair of notches 17*b* in the through hole 17*a* of the stator 17, the rotor 18 is rotated by the rotation of the rotating interlocking plate 25. As a result, the boundary portion of the poles (N pole and S pole) of the magnet section 20 of the rotor 18 corresponds to the pair of notches 17*b* in the through hole 17*a* of the stator 17, whereby the rotor 18 is in a rotatable state.

As described above, the display apparatus 8 of the wristwatch includes: the scale mark display section 10 provided in a predetermined display area, the pointer 11 that moves on the scale mark display section 10 and indicates a scale mark 9 in the scale mark display section 10, the stepping motor 12 for driving the pointer 11, the pair of stopper pins 23 and 24 for restricting the movement range of the pointer 11 that are respectively positioned in both end portions of the scale mark display section 10, and the rotating interlocking plate 25 that is a movable support section that movably supports the pair of stopper pins 23 and 24. Therefore, even when external impact is received, the stepping motor 12 can be unfailingly operated.

In other words, in the display apparatus 8, when the pointer 11 strongly presses either of the first stopper pin 23 or the second stopper pin 24 by external impact being received in a state where the stepping motor 12 is stopped by the pointer 11 being in contact with either of the first stopper pin 23 or the second stopper pin 24, the rotating interlocking plate 25 is rotated by the impact. Accordingly, the first stopper pin 23 or the second stopper pin 24 is moved.

Then, after the pointer 11 moves together with the first stopper pin 23 or the second stopper pin 24, the rotating interlocking plate 25 is rotated in the reverse direction by the rebound of the rotation, whereby the first stopper pin 23 or the second stopper pin 24 can be returned to the original position. As a result, even when the rotational position of the stepping motor 12 is misaligned, the misaligned position can be returned to the original position. Therefore, even when external impact is received, the stepping motor 12 can be unfailingly operated.

In this structure, the rotating interlocking plate 25 is arranged such that the rotating interlocking plate 25 can rotate around the rotational center of the pointer 11, and the weight balance of the rotating interlocking plate 25 differs between both sides of the rotational center. The first stopper pin 23 and the second stopper pin 24 are respectively attached to both end portions of the rotating interlocking plate 25. Therefore, even when the rotating interlocking plate 25 is rotated by external impact being received in a state where the pointer 11 is in contact with either of the first stopper pin 23 or the second stopper pin 24, the rotating interlocking plate 25 can be rotated in the reverse direction by the rebound of the rotation, and thereby returned to its original rotation position because of the weight imbalance. As a result, even when the rotational position of the stepping motor 12 is misaligned, the misaligned position can be returned to its original position.

Furthermore, in the display apparatus 8, because of the weight imbalance of the rotating interlocking plate 25, when for some reason the rotor 18 of the stepping motor 12 will not rotate in a state where the pointer 11 comes into contact with either of the first stopper pin 23 or the second stopper pin 24, the wristwatch is strongly shaken, whereby the rotating interlocking plate 25 can be forcibly rotated in either direction. As a result, the pointer 11 can be moved, and the rotor 18 of the stepping motor 12 can be forcibly rotated.

Therefore, even when the pointer 11 stops in a state where the boundary portion of the poles (N pole and S pole) of the magnet section 20 of the rotor 18 is positionally misaligned in relation to the pair of notches 17*b* in the through hole 17*a* of the stator 17, the rotor 18 can be forcibly rotated by the rotation of the rotating interlocking plate 25. As a result, the boundary portion of the poles (N pole and S pole) of the magnet section 20 of the rotor 18 can correspond to the pair of notches 17*b* in the through hole 17*a* of the stator 17, whereby the rotor 18 can be in a rotatable state.

Second Embodiment

Next, a second embodiment in which the present invention has been applied to a wristwatch will be described with reference to FIG. 6 to FIG. 8A and FIG. 8B. Note that sections that are the same as those according to the first embodiment shown in FIG. 1 to FIG. 5A and FIG. 5B are given the same reference numerals.

A display apparatus 30 of the wristwatch is configured such that a first stopper section 31 and a second stopper section 32 are respectively provided in a pair of eccentric rotating bodies 33 (movable support sections), as shown in FIG. 6 to FIG. 8A and FIG. 8B. Other configurations are substantially similar to those in the first embodiment.

The pair of eccentric rotating bodies 33, each of which includes a rotating shaft 34 and an eccentric section 35, are respectively arranged in portions of the lower dial 4 positioned in both end portions of the scale mark display section 10, as shown in FIG. 6 to FIG. 8A and FIG. 8B. In this structure, the rotating shafts 34 are rotatably attached to the housing 2 and the lower dial 4. The upper portions of the rotating shafts 34 project above the lower dial 4, the lower portions project into spaces 36 within the housing 2, and the eccentric sections 35 are respectively attached to the projected lower portions.

Figure 7:
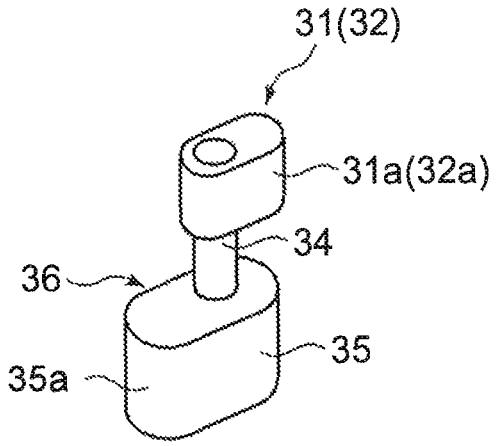
FIG. 7 is an enlarged perspective view of an eccentric rotating body of the display apparatus shown in FIG. 6.
Figure 8A:
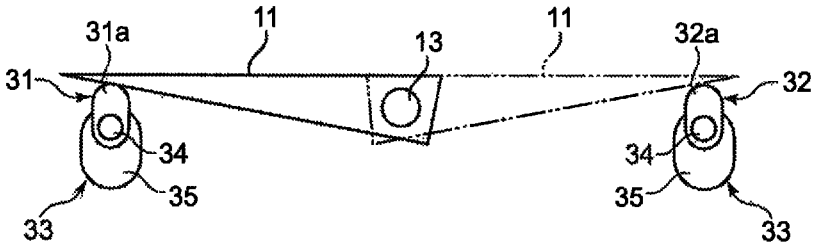
Figure 8B:
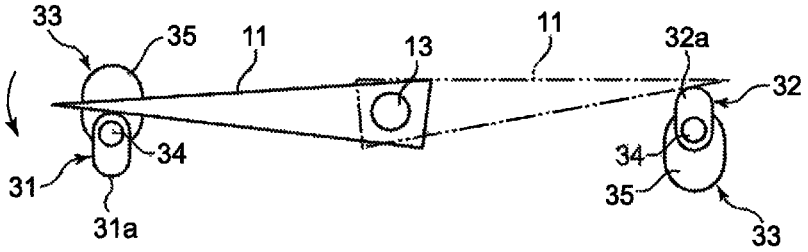

Each of the eccentric sections 35 is formed into a substantially elliptic cylindrical shape, as shown in FIG. 7, FIG. 8A, and FIG. 8B. The lower portion of the rotating shaft 34 is attached to one off-centered side portion of the eccentric section 35 (upper right side portion in FIG. 7). In this state, the eccentric section 35 rotates within the space 36 of the housing 2. In addition, each of the first stopper section 31 and the second stopper section 32 is formed into a substantially elliptic cylindrical shape that is smaller than the eccentric section 35. The upper portion of each of the rotating shafts 34 is attached to one off-centered side portion of each of the first stopper section 31 and the second stopper section 32 (lower left side portion in FIG. 7). Each of tip end sections 31*a* and 32*a* projects towards the opposite side of each of the eccentric sections 35.

Accordingly, the pair of eccentric rotating bodies 33 is configured such that the tip end section 31*a* of the first stopper section 31 and the tip end section 32*a* of the second stopper section 32 respectively project towards the pointer 11 side that moves on the scale mark display section 10. Tip end sections 35*a* of the eccentric sections 35 respectively project towards the opposite side of the pointer 11 that moves on the scale mark display section 10. As a result, the movement range of the pointer 11 is restricted by the pointer 11 coming into contact with the tip end section 31*a* of the first stopper section 31 and the tip end section 32*a* of the second stopper section 32 in this state.

In addition, the pair of eccentric rotating bodies 33 is configured as follows the pointer 11 further rotates and presses the first stopper section 31 or the second stopper section 32 in a state where the pointer 11 is in contact with the tip end section 31*a* of the first stopper section 31 or the tip end section 32*a* of the second stopper section 32 as shown in FIG. 8A and FIG. 8B. As a result, the first stopper section 31 or the second stopper section 32 is pressed and rotated around the rotation shaft 34, thereby eccentrically rotating the eccentric section 35. The eccentric section 35 is rotated in the reverse direction by the rebound of the rotation, whereby the first stopper section 31 or the second stopper section 32 is pressed back to the original position.

Furthermore, the pair of eccentric rotating bodies 33 is configured as follows: when the rotor 18 of the stepping motor 12 will not rotate in a state where the pointer 11 is in contact with either of the first stopper section 31 or the second stopper section 32, the wristwatch is strongly shaken, whereby the eccentric section 35 eccentrically is rotated around the rotation shaft 34. As a result, the first stopper section 31 and the second stopper section 32 is rotated around the respective rotation shafts 34 and forcibly rotate the pointer 11.

Next, the mechanism of the display apparatus 30 of the wristwatch will be described.

In the display apparatus 30 as well, when barometric pressure is detected by a barometric sensor (not shown) mounted in the timepiece module 1, the stepping motor 12 is rotated based on the detected data, as in the case of the first embodiment. As a result, the pointer 11 moves on the scale mark display section 10 and indicates a scale mark 9 in the scale mark display section 10 such that the pointer 11 indicates 700 (barometric pressure) as a scale mark 9 as shown in FIG. 1, whereby the barometric pressure is indicated and displayed.

On the other hand, when the barometric pressure decreases and the pointer 11 stops by coming into contact with the tip end section 31*a* of the first stopper 31 on the left side, energization of the stepping motor 12 is cut off, whereby the rotation of the rotor 18 stops. At this time as well, the rotor 18 stops in a state where the boundary portion of the poles (N pole and S pole) of the magnet section 20 of the rotor 18 corresponds to the pair of notches 17*b* in the through hole 17*a* of the stator 17. Therefore, the stepping motor 12 maintains a state where the rotor 18 can rotate the next time the barometric pressure is measured and a current is supplied to the coil section 16.

When the wristwatch receives external impact in this state and then the pointer 11 presses the tip end section 31*a* of the first stopper section 31 by the impact, the first stopper section 31 is pressed and rotated around the rotating shaft 34, thereby eccentrically rotating the eccentric section 35 of the eccentric rotating body 33. The eccentric section 35 is rotated in the reverse direction by the rebound of the rotation, whereby the pointer 11 is pressed back.

Accordingly, even when the rotor 18 of the stepping motor 12 rotates slightly and the boundary portion of the poles (N pole and S pole) of the magnet section 20 of the rotor 18 becomes positionally misaligned in relation to the pair of notches 17*b* in the through hole 17*a* of the stator 17, the pointer 11 is pressed back by the eccentric rotation of the eccentric section 35 of the eccentric rotating body 33.

As a result, in the stepping motor 12, the rotor 18 stops in a state where the boundary portion of the poles (N pole and S pole) of the magnet section 20 of the rotor 18 corresponds to the pair of notches 17*b* in the through hole 17*a* of the stator 17. Therefore, the stepping motor 12 is in a state where the rotor 18 can rotate the next time the barometric pressure is measured and a current is supplied to the coil section 16.

Similarly, when the barometric pressure increases, and the pointer 11 stops by coming into contact with the tip end section 32*a* of the second stopper section 32 on the right side, energization of the stepping motor 12 is cut off and the rotation of the rotor 18 stops. At this time as well, the rotor 18 stops in a state where the boundary portion of the poles (N pole and S pole) of the magnet section 20 of the rotor 18 corresponds to the pair of notches 17*b* in the through hole 17*a* of the stator 17. Therefore, the stepping motor 12 maintains in a state where the rotor 18 can rotate the next time the barometric pressure is measured and current is supplied to the coil section 16.

When the wristwatch receives external impact in this state and then the pointer 11 presses the tip end section 32*a* of the second stopper section 32 by the impact, the second stopper section 32 is pressed and rotated around the rotating shaft 34, thereby eccentrically rotating the eccentric section 35 of the eccentric rotating body 33. The eccentric section 35 is rotated in the reverse direction by the rebound of the rotation, whereby the pointer 11 is pressed back.

As a result, even when the rotor 18 of the stepping motor 12 rotates slightly and the boundary portion of the poles (N pole and S pole) of the magnet section 20 of the rotor 18 becomes positionally misaligned in relation to the pair of notches 17*b* in the through hole 17*a* of the stator 17, the pointer 11 is pressed back by the eccentric rotation of the eccentric section 35 of the eccentric rotating body 33.

As a result, in the stepping motor 12, the rotor 18 stops in a state where the boundary portion of the poles (N pole and S pole) of the magnet section 20 of the rotor 18 corresponds to the pair of notches 17*b* in the through hole 17*a* of the stator 17. Therefore, the stepping motor 12 is in a state where the rotor 18 can rotate the next time the barometric pressure is measured and current is supplied to the coil section 16.

Furthermore, when for some reason the rotor 18 of the stepping motor 12 will not rotate in a state where the pointer 11 is in contact with either of the first stopper section 31 or the second stopper section 32, the wristwatch is strongly shaken, whereby the eccentric section 35 of the eccentric rotating body 33 is forcibly rotated. As a result, the first stopper section 31 and the second stopper section 32 are rotated, whereby the pointer 11 is moved. As a result, the rotor 18 of the stepping motor 12 is forcibly rotated.

Therefore, even when the pointer 11 stops in a state where the boundary portion of the poles (N pole and S pole) of the magnet section 20 of the rotor 18 is positionally misaligned in relation to the pair of notches 17*b* in the through hole 17*a* of the stator 17, the rotor 18 is rotated by the eccentric rotation of the eccentric section 35 of the eccentric rotating body 35. As a result, the boundary portion of the poles (N pole and S pole) of the magnet section 20 of the rotor 18 corresponds to the pair of notches 17*b* in the through hole 17*a* of the stator 17, whereby the rotor 18 is in a rotatable state.

As described above, in the display apparatus 30 of the wristwatch, when the pointer 11 is strongly pressed against either of the first stopper section 31 or the second stopper section 32 by external impact being received in a state where the stepping motor 12 is stopped by the pointer 11 being in contact with either of the first stopper section 31 or the second stopper section 32, the pair of eccentric rotating bodies 33 is eccentrically rotated by the impact. Accordingly, the first stopper section 31 and the second stopper section 32 are moved.

Then, after the pointer 11 moves together with either of the first stopper section 31 or the second stopper section 32, the eccentric rotating body 33 is rotated in the reverse direction by the rebound of the rotation, whereby the first stopper section 31 and the second stopper section 32 can be returned to the original positions. As a result, even when the rotational position of the stepping motor 12 is misaligned, the misaligned position can be returned to the original position. Therefore, even when external impact is received, the stepping motor 12 can be unfailingly operated.

In this structure, each of the pair of eccentric rotating bodies 33 includes the rotating shaft 34 and the eccentric section 35. The rotating shaft 34 is attached to an off-centered portion of eccentric section 35. The first stopper section 31 and the second stopper section 32 are respectively attached to the rotating shafts 34. Therefore, when the pointer 11 presses against either of the first stopper section 31 or the second stopper section 32 and then eccentrically rotates the eccentric section 35, the eccentric section 35 is rotated in the reverse direction by the rebound of the rotation, whereby the first stopper section 31 and the second stopper section 32 are returned to its original positions. As a result, the rotational position of the rotor 18 can be returned to its original position.

Furthermore, display apparatus 30 is configured such that the pair of eccentric rotating bodies 33 eccentrically rotates. As a result, when for some reason the rotor 18 of the stepping motor 12 will not rotating in a state where the pointer 11 is in contact with either of the first stopper section 31 or the second stopper section 32, the wristwatch can be strongly shaken, whereby the eccentric rotating bodies 33 are forcibly eccentrically rotated and then the first stopper section 31 and the second stopper section 32 are rotated. Therefore, the pointer 11 can be moved, and the rotor 18 of the stepping motor 12 can be forcibly rotated.

Therefore, even when the pointer 11 stops in a state where the boundary portion of the poles (N pole and S pole) of the magnet section 20 of the rotor 18 is positionally misaligned in relation to the pair of notches 17*b* in the through hole 17*a* of the stator 17, the rotor 18 can be forcibly rotated by the eccentric rotation of the eccentric rotating body 33. As a result, the boundary portion of the poles (N pole and S pole) of the magnet section 20 of the rotor 18 can correspond to the pair of notches 17*b* in the through hole 17*a* of the stator 17, whereby the rotor 18 is in a rotatable state.

Third Embodiment

Next, a third embodiment in which the present invention has been applied to a wristwatch will be described with reference to FIG. 9, FIG. 10A, and FIG. 10B. In this structure as well, sections that are the same as those according to the first embodiment shown in FIG. 1 to FIG. 5A and FIG. 5B are given the same reference numerals.

Figure 9:
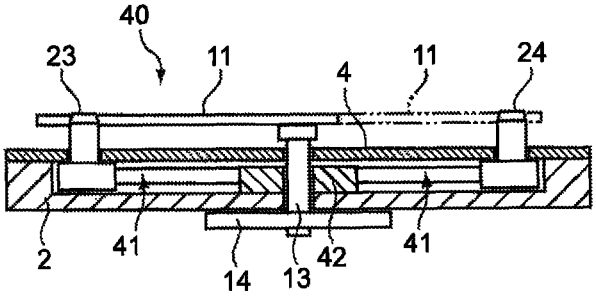
FIG. 9 is an enlarged cross-sectional view of main sections of a display apparatus of a timepiece module according to a third embodiment in which the present invention is applied to a wristwatch.
Figure 10A:
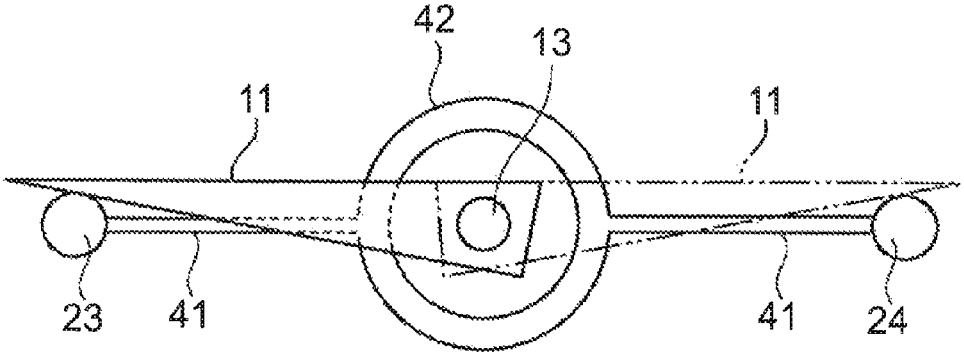
Figure 10B:
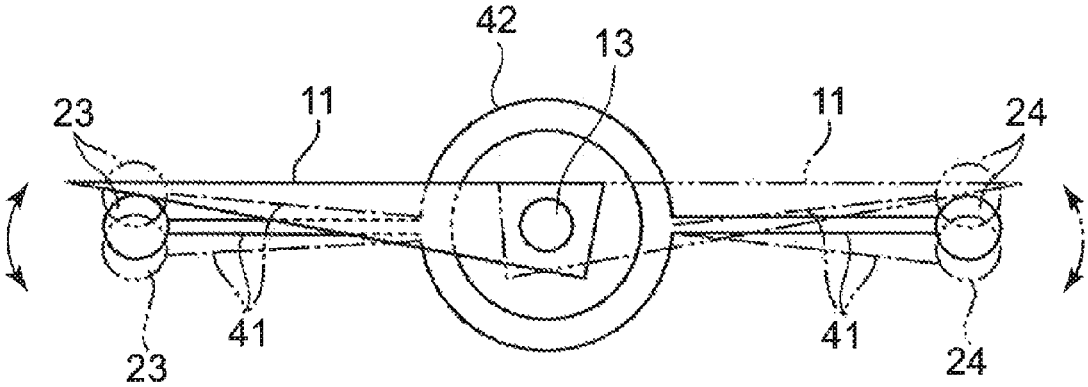

A display apparatus 40 of the wristwatch is configured such that the first stopper pin 23 and the second stopper pin 24 are respectively provided in a pair of flat springs 41 (resilient member), as shown in FIG. 9, FIG. 10A, and FIG. 103. Other configurations are substantially similar to those in the first embodiment.

In this structure, a disk-shaped fixing section 42 is provided on the housing 2, as shown in FIG. 9. The pointer shaft 13 is rotatably attached to the fixing section 42. The pair of flat springs 41 is provided on an outer peripheral portion of the fixing section 42 such that each of the pair of flat springs 41 extends towards a radial direction. The pair of flat springs 41 is configured such that each of the tip end sides of the pair of flat springs 41 is flexed and deformed along the circumferential direction of the fixing section 42, as shown in FIG. 10A and FIG. 10B. The first stopper pin 23 and the second stopper pin 24 are respectively attached to the tip end portions of the pair of flat springs 41 in a state where the first stopper pin 23 and the second stopper pin 24 respectively stand up.

The first stopper pin 23 and the second stopper pin 24 are configured such that the respective upper portions of the first stopper pin 23 and the second stopper pin 24 project above the lower dial 4 through the pair of insertion holes 26 that are respectively provided in portions of the lower dial 4 positioned on both end portions of the scale mark display section 10, as in the case of the first embodiment. Each of the pair of insertion holes 26 is formed into an arc-shaped long hole such that the center of the arc-shaped long hole coincides with the center of the pointer shaft 13. The first stopper pin 23 and the second stopper pin 24 respectively move along these long holes.

Next, the mechanism of the display apparatus 40 of the wristwatch will be described.

In the display apparatus 40 as well, when barometric pressure is detected by a barometric sensor (not shown) mounted in the timepiece module 1, the stepping motor 12 is rotated based on the detected data, as in the case of the first embodiment. As a result, the pointer 11 moves on the scale mark display section 10 and indicates a scale mark 9 in the scale mark display section 10 such that the pointer 11 indicates 700 (barometric pressure) as a scale mark 9 as shown in FIG. 1, whereby the barometric pressure is indicated and displayed.

On the other hand, when the barometric pressure decreases and the pointer 11 stops by coming into contact with the first stopper pin 23 on the left side, energization of the stepping motor 12 is cut off, whereby the rotation of the rotor 18 stops. At this time as well, the rotor 18 stops in a state where the boundary portion of the poles (N pole and S pole) of the magnet section 20 of the rotor 18 corresponds to the pair of notches 17*b* in the through hole 17*a* of the stator 17. Therefore, the stepping motor 12 maintains a state where the rotor 18 can rotate the next time the barometric pressure is measured and current is supplied to the coil section 16.

When the wristwatch receives external impact in this state and then the pointer 11 presses the first stopper pin 23 by the impact, the flat spring 41 is flexed and deformed by the first stopper pin 23 being pressed. The flat spring is resiliently returned by the rebound of the deformation, whereby the pointer 11 is pressed back. As a result, even when the rotor 18 of the stepping motor 12 rotates slightly and the boundary portion of the poles (N pole and S pole) of the magnet section 20 of the rotor 18 becomes positionally misaligned in relation to the pair of notches 17*b* in the through hole 17*a* of the stator 17, the pointer 11 is pressed back by the resilient return force of the flat spring 41.

As a result, in the stepping motor 12, the rotor 18 stops in a state where the boundary portion of the poles (N pole and S pole) of the magnet section 20 of the rotor 18 corresponds to the pair of notches 17*b* in the through hole 17*a* of the stator 17. Therefore, the stepping motor 12 is in a state where the rotor 18 can rotate the next time the barometric pressure is measured and current is supplied to the coil section 16.

Similarly, when the barometric pressure increases, and the pointer 11 stops by coming into contact with the second stopper pin 24 on the right side, energization of the stepping motor 12 is cut off and the rotation of the rotor 18 stops. At this time as well, the rotor 18 stops in a state where the boundary portion of the poles (N pole and S pole) of the magnet section 20 of the rotor 18 corresponds to the pair of notches 17*b* in the through hole 17*a* of the stator 17. Therefore, the stepping motor 12 maintains in a state where the rotor 18 can rotate the next time the barometric pressure is measured and a current is supplied to the coil section 16.

When the wristwatch receives external impact in this state and then the pointer 11 presses the second stopper pin 24 by the impact, the flat spring 41 is flexed and deformed by the second stopper pin 24 being pressed. The flat spring 41 is resiliently returned by the rebound of the deformation, whereby the pointer 11 is pressed back. As a result, even when the rotor 18 of the stepping motor 12 rotates slightly and the boundary portion of the poles (N pole and S pole) of the magnet section 20 of the rotor 18 becomes positionally misaligned in relation to the pair of notches 17*b* in the through hole 17*a* of the stator 17, the pointer 11 is pressed back by the resilient return force of the flat spring 41.

As a result, in the stepping motor 12, the rotor 18 stops in a state where the boundary portion of the poles (N pole and S pole) of the magnet section 20 of the rotor 18 corresponds to the pair of notches 17*b* in the through hole 17*a* of the stator 17. Therefore, the stepping motor 12 is in a state where the rotor 18 rotates the next time the barometric pressure is measured and a current is supplied to the coil section 16.

Furthermore, when for some reason the rotor 18 of the stepping motor 12 will not rotate in a state where the pointer 11 is in contact with either of the first stopper pin 23 or the second stopper pin 24, the wristwatch is strongly shaken, whereby the flat spring 41 is forcibly flexed and deformed. As a result, the first stopper pin 23 or the second stopper pin 24 is rotated, the pointer 11 is moved, and the rotor 18 of the stepping motor 12 is forcibly rotated.

Therefore, even when the pointer 11 stops in a state where the boundary portion of the poles (N pole and S pole) of the magnet section 20 of the rotor 18 is positionally misaligned in relation to the pair of notches 17*b* in the through hole 17*a* of the stator 17, the rotor 18 is rotated by the flexural deformation of the flat spring 41. As a result, the boundary portion of the poles (N pole and S pole) of the magnet section 20 of the rotor 18 corresponds to the pair of notches 17*b* in the through hole 17*a* of the stator 17, whereby the rotor 18 is in a rotatable state.

As described above, in the display apparatus 40 of the wristwatch, when the pointer 11 is strongly pressed against either of the first stopper pin 23 or the second stopper pin 24 by external impact being received in a state where the stepping motor 12 is stopped by the pointer 11 being in contact with either of the first stopper pin 23 or the second stopper pin 24, the flat spring 41 is flexed and deformed by the impact, and either of the first stopper pin 23 or the second stopper pin 24 can be moved.

Therefore, after the pointer 11 moves together with either of the first stopper pin 23 or the second stopper pin 24, the flat spring 41 can be resiliently returned by the rebound of the movement. Accordingly, either of the first stopper pin 23 or the second stopper pin 24 can be returned to the original position. As a result, even when the rotational position of the stepping motor 12 is misaligned, the misaligned position can be returned to the original position. Therefore, even when external impact is received, the stepping motor 12 can be unfailingly operated.

In this structure, the pair of flat springs 41 flexes and deforms in a direction where the pair of flat springs 41 rotates around the pointer shaft 13. Therefore, when for some reason the rotor 18 of the stepping motor 12 will not rotating in a state where the pointer 11 comes into contact with either of the first stopper pin 23 or the second stopper pin 24, the wristwatch can be strongly shaken, whereby the pair of flat springs 41 is forcibly flexed and deformed. As a result, the first stopper pin 23 and the second stopper pin 24 can be rotated, whereby the pointer 11 can be moved and the rotor 18 of the stepping motor 12 can be forcibly rotated.

Therefore, even when the pointer 11 stops in a state where the boundary portion of the poles (N pole and S pole) of the magnet section 20 of the rotor 18 is positionally misaligned in relation to the pair of notches 17*b* in the through hole 17*a* of the stator 17, the rotor 18 can be forcibly rotated by the flexural deformation of the pair of flat springs 41. As a result, the boundary portion of the poles (N pole and S pole) of the magnet section 20 of the rotor 18 can correspond to the pair of notches 17*b* in the through hole 17*a* of the stator 17, whereby the rotor 18 is in a rotatable state.

According to the above-described third embodiment, the flat springs 41 are used as the movable supporting section. However, the present invention is not limited thereto. For example, other spring members, such as a coil spring may be used. In addition, the present invention is not limited to spring members, and elastic members such as urethane resin or rubber may be used.

In addition, according to the above-described first to third embodiments, the scale mark display section 10 is provided with scale marks 9 for displaying barometric pressure or the like. However, the present invention is not limited thereto, and may be applied for displaying temperature, humidity, the wax and wane of the moon, the rise and fall of the tides, speed, and the like.

In addition, according to the above-described first to third embodiments, the first stopper pin 23 and the second stopper pin 24, or the first stopper section 31 and the second stopper section 32 are provided on both sides of the scale mark display section 10. However, the first stopper pin 23 and the second stopper pin 24, or the first stopper section 31 and the second stopper section 32 are not necessarily required to be provided on both sides of the scale mark display section 10. Either of the first stopper pin 23 or the second stopper pin 24, or either of the first stopper section 31 or the second stopper section 32 may be provided on at least only one side of the scale mark display section 10.

Furthermore, according to the above-described first to third embodiments, the present invention is applied to a dial-type wristwatch. However, the present invention is not necessarily required to be applied to a wristwatch, and may be applied to various types of clocks, such as travel clocks, alarm clocks, mantelpiece clocks, and wall clocks. Moreover, the present invention is not necessarily required to be applied to clocks, and may be applied to meters, such as a speedometer.

While the present invention has been described with reference to the preferred embodiments, it is intended that the invention be not limited by any of the details of the description therein but includes all the embodiments which fall within the scope of the appended claims.

What is claimed is:

1. A display apparatus comprising:

a scale mark display section which is provided in a predetermined display area;

a pointer which moves on the scale mark display section and indicates a scale mark in the scale mark display section;

a stepping motor which drives the pointer;

a stopper section which is positioned in an end section of the scale mark display section and which restricts a movement range of the pointer; and a movable supporting section which movably supports the stopper section, wherein the movable supporting section comprises a rotating interlocking plate which is arranged such that the rotating interlocking plate is rotatable around a rotational center of the pointer, wherein a weight balance differs between both sides of the rotational center, and wherein the stopper section is respectively attached to both end sections of the rotating interlocking plate.

2. An electronic timepiece comprising:

a display device according to claim 1.

3. A display apparatus comprising:

a scale mark display section provided in a predetermined display area;

a pointer which moves on the scale mark display section and indicates a scale mark in the scale mark display section;

a stepping motor which drives the pointer;

a stopper section which is positioned in an end section of the scale mark display section which restricts a movement range of the pointer; and a movable supporting section which movably supports the stopper section, wherein the movable supporting section comprises an eccentric rotating body which eccentrically rotates, and the stopper section is attached to the eccentric rotating body, wherein the eccentric rotating body has a rotating shaft and an eccentric section, wherein the eccentric section is formed into a substantially elliptic cylindrical shape, and a lower portion of the rotating shaft is attached to one off-centered side portion of the eccentric section, and wherein the stopper section is formed into a substantially elliptic cylindrical shape that is smaller than the eccentric section, and an upper portion of the rotating shaft is attached to one off-centered side portion of the stopper section.

4. An electronic timepiece comprising:

a display device according to claim 3.

* * * * *